US007833110B2

(12) United States Patent
Nakamura

(10) Patent No.: US 7,833,110 B2
(45) Date of Patent: Nov. 16, 2010

(54) GOLF CLUB HEAD

(75) Inventor: Takashi Nakamura, Kobe (JP)

(73) Assignee: SRI Sports Limited, Kobe (JP)

( * ) Notice: Subject to any disclaimer, the term of this patent is extended or adjusted under 35 U.S.C. 154(b) by 23 days.

(21) Appl. No.: 12/285,075

(22) Filed: Sep. 29, 2008

(65) Prior Publication Data

US 2009/0118033 A1 May 7, 2009

(30) Foreign Application Priority Data

Nov. 7, 2007 (JP) ..... 2007-289976

(51) Int. Cl.
*A63B 53/04* (2006.01)

(52) U.S. Cl. ..... 473/332

(58) Field of Classification Search ..... 473/324–350
See application file for complete search history.

(56) References Cited

U.S. PATENT DOCUMENTS

2007/0049400 A1* 3/2007 Imamoto et al. ..... 473/329
2007/0049413 A1* 3/2007 Matsunaga ..... 473/345
2007/0129160 A1* 6/2007 Matsunaga et al. ..... 473/332
2007/0129161 A1* 6/2007 Matsunaga et al. ..... 473/332
2007/0129164 A1* 6/2007 Shimazaki et al. ..... 473/338
2007/0129165 A1 6/2007 Matsunaga et al.
2007/0129166 A1* 6/2007 Shimazaki et al. ..... 473/345
2007/0129168 A1* 6/2007 Matsunaga et al. ..... 473/349
2007/0149313 A1* 6/2007 Matsunaga et al. ..... 473/332
2008/0085782 A1* 4/2008 Kubota ..... 473/350
2009/0088267 A1* 4/2009 Shimazaki et al. ..... 473/332
2009/0240479 A1* 9/2009 Matsunaga et al. ..... 703/2
2009/0247321 A1* 10/2009 Matsunaga et al. ..... 473/350

* cited by examiner

*Primary Examiner*—Alvin A Hunter
(74) *Attorney, Agent, or Firm*—Birch, Stewart, Kolasch & Birch, LLP

(57) ABSTRACT

A golf club head with a vibration absorber capable of absorbing unpleasant vibrations on off-center hits without absorbing agreeable vibrations on on-center hits is disclosed. The head comprises a head main body made of a metal material, and a vibration absorber made of a visco-elastic material attached to the head main body, wherein the loss tangent of the vibration absorber exhibits its maximum value within a temperature range of −20 to 50 deg.C., the loss tangent at 30 deg.C. is not less than 0.30, and the loss tangent at −40 deg.C. is less than 0.20.

6 Claims, 4 Drawing Sheets

GOLF CLUB HEAD

BACKGROUND OF THE INVENTION

The present invention relates to a golf club head with a vibration absorber capable of absorbing unpleasant vibrations on off-center hits without absorbing agreeable vibrations on on-center hits.

In the U.S. Patent Application Publication No. 2007-129165-A1, there is disclosed a golf club head provided with a vibration absorber to absorb vibration of a golf club head at impact, wherein the absorber is made of a first visco-elastic material and a second visco-elastic material whose loss coefficient (loss tangent) has a different temperature dependency than that of the first visco-elastic material so as to cover a wide frequency range of the vibrations.

On the other hand, it is empirically well known to the golfers that, in the case of good shots such that the ball is hit at the sweet spot of the club face (namely, on-center hit), the player feels solid agreeable vibration at the hands through the grip, but in the case of miss shots such that the ball is hit off the sweet spot (namely, off-center hit), the player feels dull unpleasant vibration and sometimes numbness at the hands.

Thus, the vibration include the agreeable vibrations on on-center hits, and the unpleasant vibrations on off-center hits.

From various test results, it was confirmed that the vibrations on on-center hits are higher in the frequency than the vibrations on off-center hits.

As in the above-mentioned prior art, if a plurality of visco-elastic materials different in the loss coefficient are used in one golf club head in order to absolve vibrations of a wide frequency range, then not only the unpleasant vibrations on off-center hits but also the agreeable vibrations on on-center hits are absorbed. Therefore, the impact feeling is blurred and considered as being not good for advanced golfers in particular, and as a result, the golf club head is felt by the player as being difficult to control the ball.

The present inventor quantitatively investigated the vibrations of a golf club head at impact as follows: an iron-type club head with an acceleration pickup attached to the hosel portion was suspended by a thread; the club face was hit with a hammer to apply an impact; the acceleration was measured at the hosel portion by the use of the acceleration pickup; and the impulse response (frequency transfer function) of the club head was measured with respect to various hitting positions of the club face.

From the results of the above-mentioned experimentation, it was discovered that the frequency spectrum of the vibration when hit the ball at the sweet spot has a peak at a frequency of about 3 kHz, whereas the frequency spectrum of the vibration when hit the ball off the sweet spot has a peak at a frequency of lower than about 2 kHz.

Therefore, in order for the unpleasant vibrations on off-center hits to be reduced effectively while keeping the agreeable vibrations on on-center hits as much as possible, it is important that the vibration absorber is made from a material whose vibration absorbing power is low around 3 kHz but high around 2 kHz or less.

The present inventor further studied and discovered that such desirable vibration absorbing power can be obtained by controlling or adjusting the temperature dependency of the loss tangent of a visco-elastic material. More specifically, the temperature at which the loss tangent becomes its maximum value is set in a specific high-temperature range, and the loss tangent at 30 deg.C. is increased to a specific value, and the loss tangent at −40 deg.C. is decreased to a specific value.

SUMMARY OF THE INVENTION

It is therefore, an object of the present invention to provide a golf club head, in which, unpleasant vibrations on miss shots can be effectively absorbed while keeping pleasant vibrations on good shots as much as possible, and thereby the impact feeling is prevented from becoming blurred so that the head can provide a good impact feeling.

According to the present invention, a golf club head comprises a head main body made of a metal material, and a vibration absorber made of a single visco-elastic material attached to the head main body, wherein the loss tangent of the vibration absorber exhibits its maximum value in a temperature range between −20 and 50 deg.C., and the loss tangent is not less than 0.30 when measured at 30 deg.C., and less than 0.20 when measured at −40 deg.C.

The inventor discovered through various tests that: on the condition that the temperature of the maximum loss tangent is between −20 and 50 deg.C., by increasing the loss tangent at 30 deg.C. to be at least 0.30, the vibrations in a low frequency range of not more than 2 kHz caused on miss shots can be effectively absorbed, and by decreasing the loss tangent at −40 deg.C. to be under 0.20, the absorbing power is decreased with respect to the high-frequency vibrations of about 3 kHz caused on good shots. Therefore, unpleasant vibrations on off-center hits can be absorbed without absorbing the agreeable vibrations on on-center hits, and as a result, it is possible to provide a club head easy to control the ball.

DESCRIPTION OF THE PREFERRED EMBODIMENTS

Figure 5:
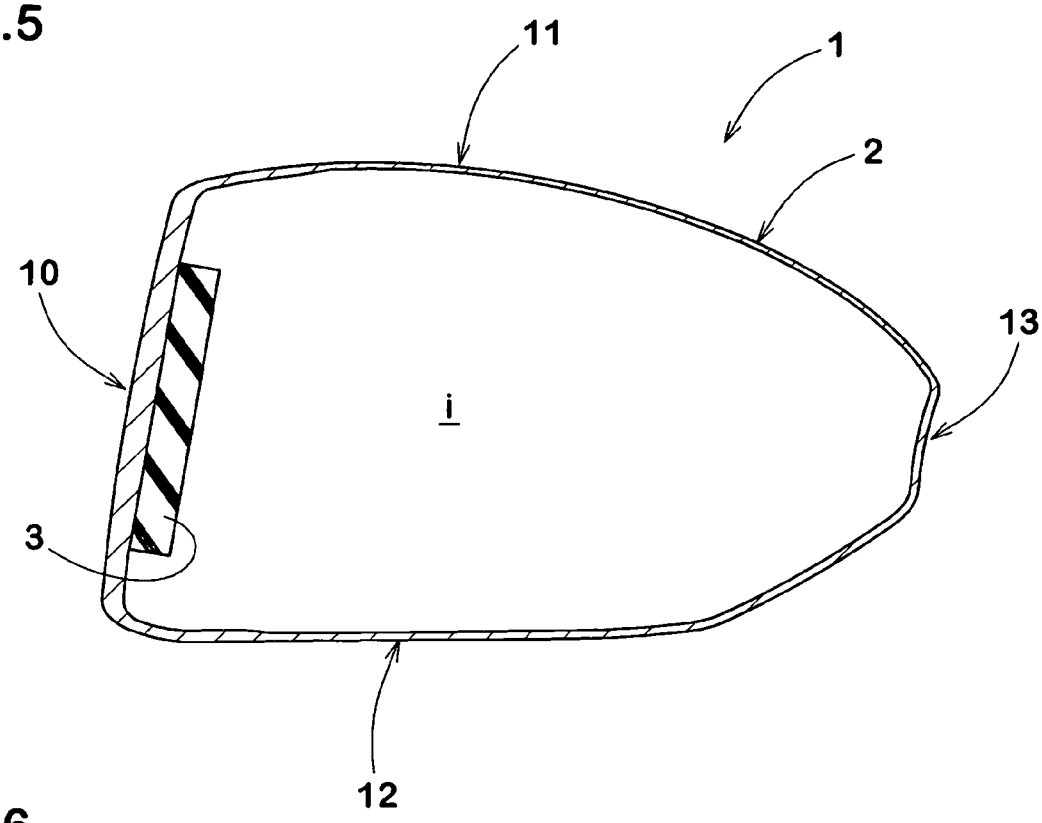
FIG. 5 is a cross sectional view of a wood-type golf club head according to the present invention.
Figure 6:
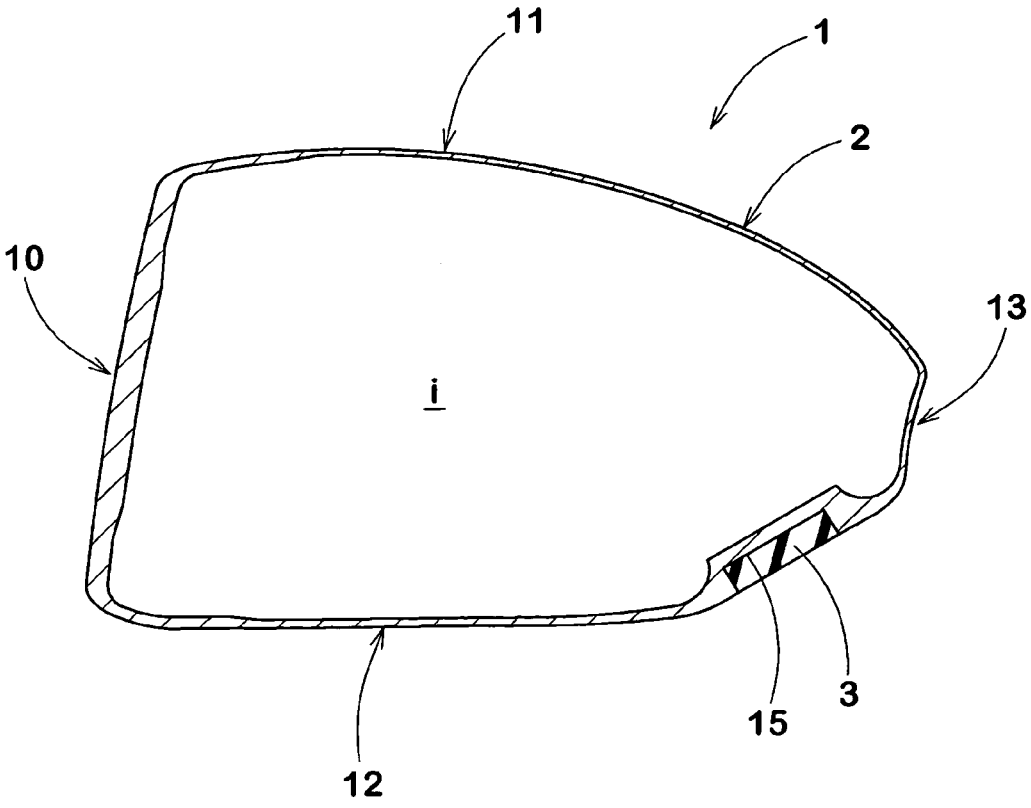
FIG. 6 is a cross sectional view of another example of the wood-type golf club head.

Embodiments of the present invention will now be described in detail in conjunction with accompanying drawings. In FIGS. 1, 2, 3 and 4, club heads 1 according to the present invention are an iron-type club head 1. In FIGS. 5 and 6, club heads 1 according to the present invention are a wood-type hollow club head 1. In either case, the head 1 comprises a head main body 2, and a vibration absorber 3 made of a visco-elastic material.

Various metal materials can be used to make the head main body 2.

In the case of the iron-type golf club head 1, preferably, carbon steels, e.g. soft iron and the like, stainless steels, chrome-molybdenum steels, maraging steels and the like can be used for the head main body 2. From the aspect of the impact feeling and easiness of processing in particular, carbon steels and stainless steels are suitably used.

In the case of the wood-type club heads 1, in addition to the above-mentioned metal materials, other materials such as titanium alloys, aluminum alloys and the like can be also used.

The vibration absorber 3 has a loss tangent (tan delta) as a function of the temperature which exhibits its maximum within a temperature range of −20 to 50 deg.C., and the loss tangent is not less than 0.30 when measured at 30 deg.C., and less than 0.20 when measured at 31 40 deg.C.

Figure 7:
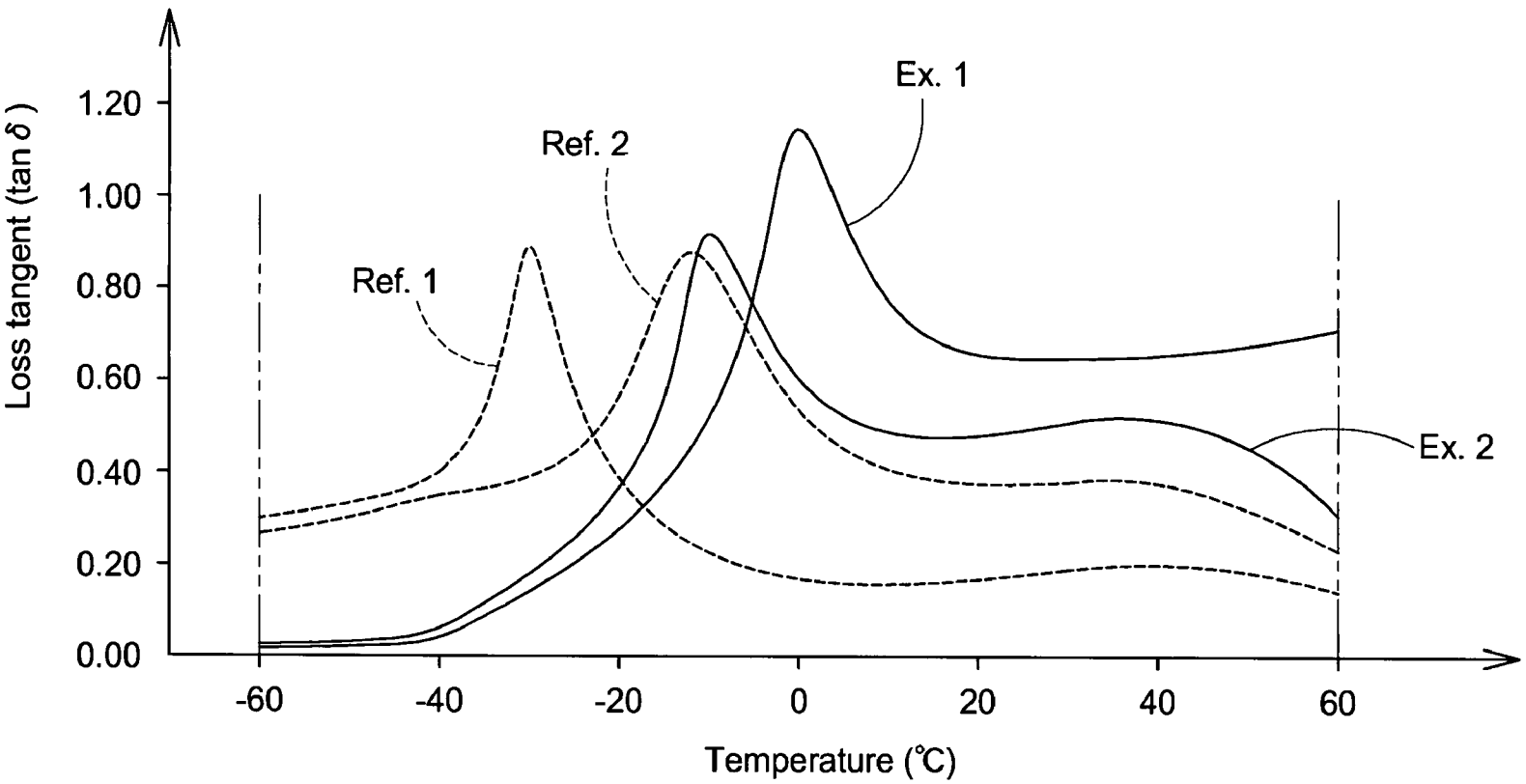
FIG. 7 a graph showing the loss tangent of each of vibration absorbers used in the undermentioned comparison tests.

The loss tangent is measured during increasing the temperature of the specimen from −60 deg.C. to 60 deg.C. at a constant increasing rate of 2 deg.C./min under the following conditions:

Frequency: 10 Hz
Displacement: 20 mm
Initial strain: 2 mm
Amplitude: +−12 micrometer
Load: tension
Specimen size: 30 mm×5 mm×2 mm and a graph of the loss tangent as a function of the temperature is plotted as shown in FIG. 7, and the above-mentioned temperature of the maximum loss tangent, and the values of the loss tangent at 30 deg.C. and −40 deg.C. are determined.

In FIG. 7, loss tangent curves of four different materials are shown when the temperature is changed without changing the frequency (10 Hz), the loss tangent of a visco-elastic material becomes maximum at a peculiar temperature depending on the composition of the material as shown in the figure.

In order to effectively absorb the vibrations at miss shots whose frequency is in a relatively low frequency range of not more than 2 kHz, the vibration absorber 3 has to have a visco-elastic property such that the loss tangent at high temperature is relatively large.

To achieve this, the vibration absorber 3 is prepared so that the maximum value of the loss tangent (tan delta) occurs in a relatively high-temperature range of from −20 to 50 deg.C. Thereby, the vibration absorbing power in a low frequency range of not more than 2 kHz can be increased.

If the temperature of the maximum loss tangent is lower than −20 deg.C., the vibration absorbing power in the low frequency range decreases, therefore, it is difficult to absorb almost all vibrations at miss shots.

But, vibrations in a high-frequency range is easily absorbed. Namely, the vibrations at good shots are absorbed to blur the impact feeling. If the temperature of the maximum loss tangent is higher than 50 deg.C., the vibration absorbing power is shifted towards a frequency range above the possible highest frequency range of the vibrations of the club head 1 at impact. Accordingly, the absorber produces no effect in substance. From these perspectives, it is preferred that the temperature of the maximum loss tangent is not lower than −10 deg.C., more preferably not lower than −5 deg.C.

On the other hand, a visco-elastic material has a tendency to become brittle at normal temperatures when the temperature of the maximum loss tangent becomes increased, therefore, it is preferable that the temperature of the maximum loss tangent is not higher than 40 deg.C., more preferably not more higher than 30 deg.C.

From the results of various tests made by the inventor, there was found a positive correlation between the loss tangent at 30 deg.C. and the vibration absorbing power with respect to the vibrations in the low frequency range of not higher than 2 kHz being liable to occur at miss shots. Namely, to increase the loss tangent at 30 deg.C. is effectual for absorbing the vibrations in the low frequency range of not higher than 2 kHz. If the loss tangent at 30 deg.C. is less than 0.30, it becomes difficult to realize the absorbing power with respect to the vibrations at miss shots. Therefore, the loss tangent at 30 deg.C. has to be not less than 0.30, preferably not less than 0.40, more preferably not less than 0.50.

The vibration absorbing power is improved with the increase in the loss tangent at 30 deg.C., therefore, the upper limit does not need to be defined, but in view of a realistic possibility, the loss tangent at 30 deg.C. is at most about 2.00.

Further, there was found a negative correlation between the loss tangent at −40 deg.C. and the vibration absorbing power with respect to the high-frequency vibrations of about 3 kHz being liable to occur at the time of good shots. Namely, to decrease the loss tangent at −40 deg.C. as much as possible is effectual for absorbing the high-frequency vibrations of about 3 kHz.

If the loss tangent at −40 deg.C. is not less than 0.20, the vibrations at good shots are undesirably absorbed and the impact feeling is liable to become blurred. Therefore, the loss tangent at −40 deg.C. has to be less than 0.20, preferably not more than 0.15, more preferably not more than 0.10.

As the loss tangent at −40 deg.C. is decrease more, the vibrations at good shots are more kept unabsorbed, therefore, it is not necessary to define the lower limit, but in view of a realistic possibility, the loss tangent at −40 deg.C. is at least about 0.02.

If the value of the maximum loss tangent becomes too small, the vibration absorbing frequency range may stay within the low frequency range but tends to become narrower, and further it becomes difficult to increased the loss tangent at 30 deg.C. On the other hand, if the maximum loss tangent is too large, it has an adverse affect on the vibrations at good shots. Therefore, it is not critical, but preferable that the maximum loss tangent is set in a range of not less than 0.80, more preferably not less than 0.90, still more preferably not less than 1.0, but not more than 2.5, more preferably not more than 2.3, still more preferably not more than 2.1.

The difference of the loss tangent at 30 deg.C. from the loss tangent at −40 deg.C. is more than 0.10 accordingly. If the difference is too large, the vibrations at good shots are spoiled, therefore, it is preferable that the difference is set in a range of not more than 0.90, more preferably not more than 0.80, still more preferably not more than 0.70.

On the other hand, if the difference is too small, the object of the present invention can not be achieved, therefore the difference is set in a range of not less than 0.15, more preferably not less than 0.20, still more preferably not less than 0.30.

As far as the loss tangent satisfies the above-mentioned limitations, various visco-elastic materials can be used for the vibration absorber 3. For example, resins and rubber compounds are preferably used. Especially preferably used are vulcanized rubber compounds of which rubber polymers include not less than 50 weight % of styrene-butadiene rubber and/or isoprene rubber.

It is possible to further mix another rubber, for example, natural rubber, butadiene rubber, styrene-butadiene rubber of a different composition and the like in order to adjust the temperature dependency of the loss tangent and to control the workability.

In the case of isoprene rubber, 3,4-polyisoprene rubber whose maximum loss tangent occurs at about 0 deg.C. is preferable to 1,2-polyisoprene rubber.

In the case of styrene-butadiene rubber, it is preferable that the styrene content of the polymer is increased, especially, the styrene content is set in a range of not less than 10 weight %, more preferably not less than 15 weight %, still more preferably not less than 20 weight %. This facilitates the shifting of the temperature of the maximum loss tangent towards the high-temperature range. However, if the styrene content is increased too much, the viscosity in the unvulcanized state is increased and the workability becomes worsen, therefore, the styrene content is preferably set in a range of not more than 55 weight %, more preferably not more than 52 weight %, still more preferably not more than 48 weight %.

The loss tangent can be increased by:

depolymerising or mechanically and/or chemically splitting the polymers into those having smaller molecular weights;

decreasing the range of the molecular weight distribution of the polymers by making the polymers to have substantially same molecular weights by raising the precision of the polymerisation;

making the polymers to have normal chains as much as possible; and/or adding a plasticizer.

By doing the opposites, the loss tangent can be decreased, therefore, the loss tangent can be controlled or adjusted to have the above-mentioned desirable values.

The contact area of the vibration absorber 3 with the head main body 2 is set in a range of not less than 1.0 sq.cm, preferably not less than 1.5 sq.cm, more preferably not less than 2.0 sq.cm, but not more than 60.0 sq.cm, preferably not more than 55.0 sq.cm, more preferably not more than 50.0 sq.cm. Therefore, the vibration of the head main body 2 at impact is transformed into heat and the vibration is effectively absorbed. If the contact area is too small, it becomes difficult to absorb the unpleasant vibrations. If the contact area is too large, since the vibration absorber 3 becomes large, and there is a possibility that the weight of the club head is unfavorably increased.

Incidentally, in the case that the vibration absorber 3 contacts with the head main body 2 through a thin film of an adhesive agent, in so far as the film has no substantial thickness for example under 0.5 mm, these parts can be considered as being directly contacts with each other, and counted as the contact area.

The volume of the vibration absorber 3 is not critical, but it is preferable that the volume is set in a range of not less than 0.4 cc, more preferably not less than 0.5 cc, still more preferably not less than 0.6 cc, but not more than 3.0 cc, more preferably not more than 2.8 cc, still more preferably not more than 2.6 cc. If the volume is too small, the vibration absorbing power is liable to become insufficient. If the volume is too large, the weight of the club head is unfavorably increased.

In the case of the iron-type club heads 1 as shown in FIGS. 1-4, the head 1 comprises a head main body 2 made of one or more metal materials, and a vibration absorber 3 made of a single visco-elastic material as above.

The head main body 2 comprises a main portion 2A, and a hosel portion 2B to be attached to an end of a club shaft.

The hosel portion 2B is integrally formed at the heel-side end of the main portion 2A.

The main portion 2A has a club face 4 for striking a ball, a circumferential face 5 extending rearwards from the circumferential edge of the club face 4, and a rear face 6 being opposite to the club face 4 and continued from the rear edge of the circumferential face 5.

The circumferential face 5 comprises a top surface 5*a* of an upper part of the head, a bottom surface 5*b* of a sole part of the head, and a toe-side surface 5*c* of a toe-side part of the head extending in an up-and-down direction between the top surface 5*a* and the bottom surface 5*b*.

The rear face 6 dents towards the club face 4 and an open cavity C is formed, therefore, the mass of the main portion 2A is shifted toward its peripheral part, and a moment of inertia of the club head 1 is advantageously increased.

Figure 1:
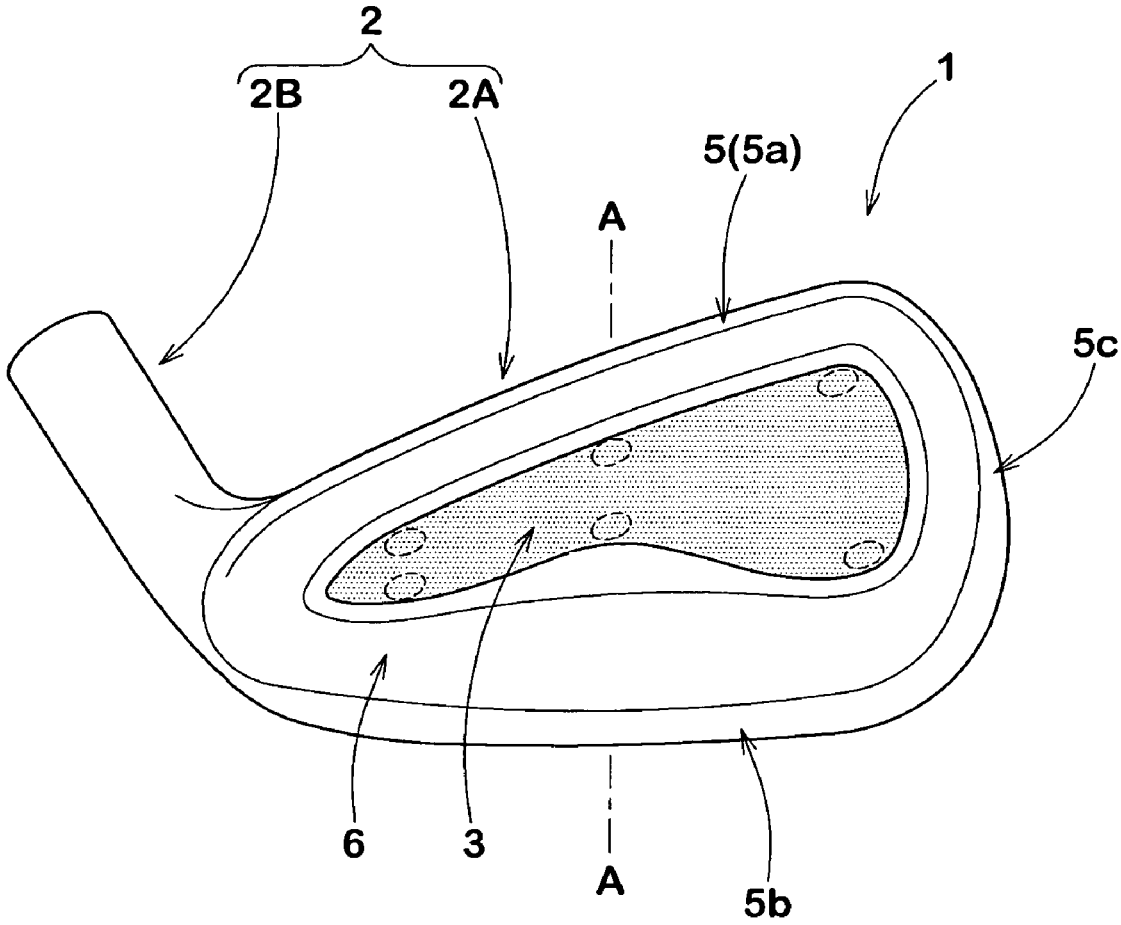
FIG. 1 is a rear view of an iron-type golf club head according to the present invention.
Figure 2:
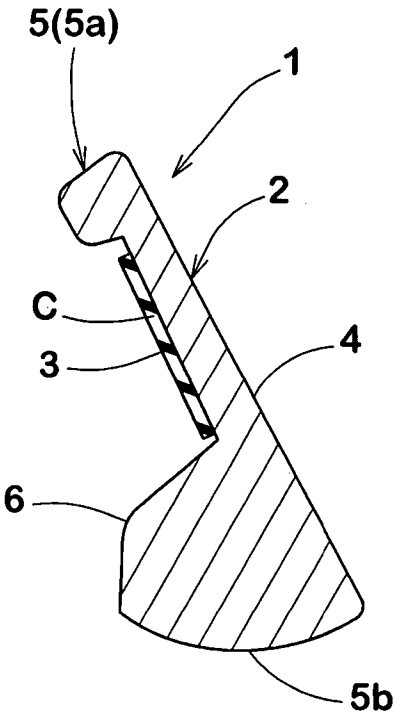
FIG. 2 is a cross sectional view taken along of line A-A of FIG. 1.

In the example shown in FIGS. 1 and 2, the vibration absorber 3 is a sheet of the visco-elastic material which is a rubber material having a substantially constant thickness. The vibration absorber 3 is adhered to the rear face 6 within the cavity C.

Figure 3:
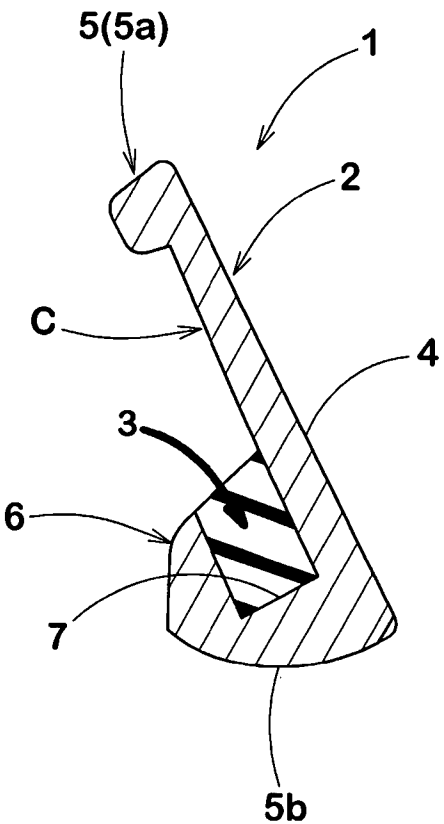
FIG. 3 is a cross sectional view of another example of the iron-type golf club head.

In FIG. 3 showing another example of the iron-type club head 1, the vibration absorber 3 is placed within a pocket 7 formed in a lower part of the cavity c by further undercutting the sole part. In this example, the contact area of the vibration absorber 3 with the head main body 2 can be advantageously increased.

Figure 4:
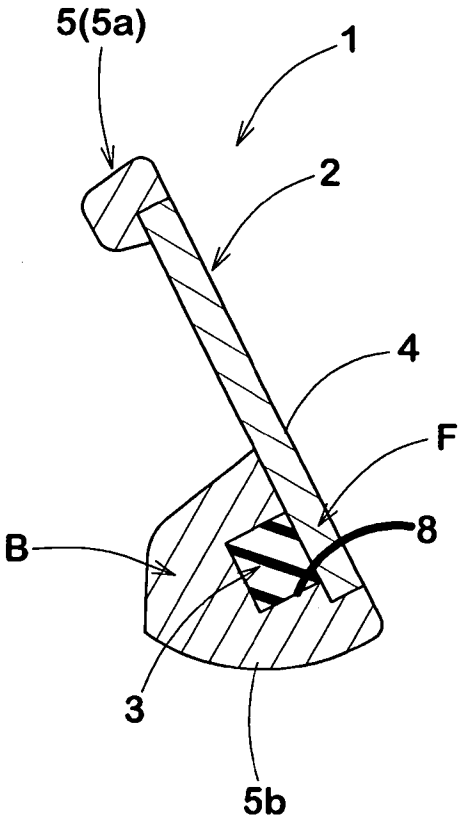
FIG. 4 is a cross sectional view of still another example of the iron-type golf club head.

In FIG. 4 showing another example of the iron-type club head 1, the head main body 2 is composed of a metal face plate F and a metal frame B for supporting a peripheral part of the face plate F. And between the face plate F and frame B, a closed hollow 8 is formed within the hollow 8, the vibration absorber 3 is placed in its compressed state. In this example, therefore, the entire surface area of the vibration absorber 3 contacts with the head main body 2. Thus, it becomes possible to bring out the vibration absorbing power maximally.

In FIGS. 5 and 6, each of the wood-type golf club heads 1 comprises a head main body 2 having a hollow structure made of one or more metal materials, and a vibration absorber 3 attached to the head main body 2.

The hollow structure comprises: a face portion 10 whose front face defines a club face 4 for striking a ball; a crown portion 11 intersecting the club face at the upper edge thereof; a sole portion 12 intersecting the club face at the lower edge thereof; and a side portion 13 between the crown portion and sole portion.

In FIG. 5, the vibration absorber 3 is a sheet of the visco-elastic material having a substantially constant thickness. The absorber 3 is fixed to the backside of the face portion 10 by means of an adhesive agent for example.

In FIG. 6, the sole portion 12 is provided in a rear part thereof with a circular recess 15. The vibration absorber 3 has a substantially circular shape and the absorber 3 is fitted into the recess 15 and fixed by means of an adhesive agent for example. Incidentally, it is also possible to form the recess 15 in the side portion 13 rather than the sole portion 12.

As explained above, the vibration absorber 3 can be formed in a variety of shapes and fixed to a variety of positions of the head main body.

The vibration absorber 3 can be disposed in two or more positions separately, for example, two positions in the face portion 10 as shown in FIG. 5 and in the sole portion 12 as shown in FIG. 6, two positions on the rear face 6 as shown in FIG. 2 and in the closed hollow 8 as shown in FIG. 4 and the like.

In the case that two or more vibration absorbers 3 are used in two or more different positions, respectively, each of the vibration absorbers 3 is made of the above-mentioned visco-elastic material as explained above, but, it is not always necessary that the vibration absorbers 3 are made of the identical visco-elastic materials.

Further, the present invention can be applied to patter-type club heads, utility-type club heads and the like.

Comparison Tests

Identical head main bodies formed by forging a soft iron (s25c) as shown in FIGS. 1 and 2 were prepared using rubber compounds shown in Table 2, vibration absorbers shown in FIGS. 1 and 2 were made.

The compounding ingredients of each compound shown in FIG. 2 were kneaded by the use of a Banbury mixer and rolled to 2.0 mm thickness and then vulcanized at 175 deg.C. for 10 minutes. The sheet formed was cut into the specific shape of the vibration absorber.

Each of the vibration absorbers was fixed to the rear face 6 within the cavity c by the use of a double-sided adhesive tape and an adhesive agent. The adhesive agent (epoxy resin adhesive #1500 manufactured by cemedine Co., Ltd.) was applied to six spots as shown in FIG. 1 by broken line. The double-sided adhesive tape was applied to the allover area of one side of the vibration absorber.

The iron-type club heads formed as above were tested as follows.

Damping Factor Test:

Firstly, the impulse response (frequency transfer function) of the head main body alone was determined by suspending and hitting the head main body and measuring the acceleration as explained above, with respect to each of hitting positions which were the sweet spot and a position 30.0 mm off the sweet spot towards the toe.

In the case of the sweet spot, a solo remarkable peak occured at 2.88 kHz. In the case of the 30.0 mm off-center position, two remarkable peaks occurred at 2.88 kHz and 1.70 kHz. Therefore, it was considered that to be absorbed were vibrations around 1.70 kHz, and to be maintained were vibrations around 2.88 kHz.

Further, the impulse response (frequency transfer function) of the head main body to which the vibration absorber was fixed, namely, the finished head was measured in the same way as above. Then, with respect each of peaks occured around 2.88 kHz and 1.70 kHz, the damping factor η was calculated according to the half-width method, namely, $$\eta=(f2-f1)/f0$$

wherein f0: the frequency of the peak in question, f1, f2: the frequencies at which the power becomes one half of that of the peak (decreased −3 dB) on each side of the peak frequency f0.

Hitting Test:

The above-mentioned iron-type heads were attached to identical golf club shafts to make iron clubs with respect to each of the clubs, ten advanced golfers whose handicaps ranging from 1 to 10 hit golf balls ("SRIXON Z-UR" manufactured by SRI sports Ltd.) to evaluate the impact feeling. More specially, the vibrations on good shots felt by the golfers' hands were evaluated into five ranks as to whether the vibration was pleasant and solid, wherein the larger the rank number, the better the impact feeling. Also the vibrations on miss shots felt by the golfers' hands were evaluated into five ranks as to the magnitude of the unpleasant vibration, wherein the larger the rank number, the smaller the magnitude (namely, the better the impact feeling).

The results are shown in Table 1,

The test results show that the club heads Ex. 1 and Ex. 2 according to the present invention could reduce the unpleasant vibrations on miss shots without reducing the vibrations on good shots, but the club heads Ref. 1 and Ref. 2 absorbed the vibrations on good shots, and as a result, the impact feeling on good shots was deteriorated.

TABLE 1

| Head | Ex. 1 | Ex. 2 | Ref. 1 | Ref. 2 |
|---|---|---|---|---|
| Vibration absorber | | | | |
| Volume (cc) | 1.8 | 1.8 | 1.8 | 1.8 |
| Contact area with main body (sq.cm) | 9.0 | 9.0 | 9.0 | 9.0 |
| Compound | A | B | C | D |
| Loss tangent | | | | |
| @ 20 deg. C. | 0.83 | 0.62 | 0.28 | 0.50 |
| @ 30 deg. C. | 0.65 | 0.51 | 0.19 | 0.38 |
| @-40 deg. C. | 0.04 | 0.06 | 0.40 | 0.35 |
| Maximum | 1.15 | 0.92 | 0.89 | 0.88 |
| Temperature (deg. C.) | 0.0 | −10 | −30 | −12 |
| Vibration damping factor (%) | | | | |
| 1.70 kHz | 1.23 | 0.86 | 0.23 | 0.80 |
| 2.88 kHz | 0.21 | 0.29 | 0.79 | 0.75 |
| Hitting Test | | | | |
| good shot | 4.5 | 4.2 | 2.9 | 2.5 |
| miss shot | 4.0 | 3.9 | 1.2 | 3.8 |

TABLE 2

| Compound | A | B | C | D |
|---|---|---|---|---|
| Rubber | | | | |
| 3,4 polyisoprene rubber (weight %) | 100 | 0 | 0 | 0 |
| styrene-butadiene rubber *1 (weight %) | 0 | 100 | 0 | 70 |
| styrene-butadiene rubber *2 (weight %) | 0 | 0 | 100 | 0 |
| natural rubber (weight %) | 0 | 0 | 0 | 30 |
| Stearic acid (PHR) | 2 | 2 | 2 | 2 |
| Zinc oxide (PHR) | 3 | 3 | 3 | 3 |
| Powdered sulfur (PHR) | 2 | 2 | 2 | 2 |
| Accelerator (PHR) | 1.2 | 1.2 | 1.2 | 1.2 |

*1 Asahi Kasei Corporation "E-10"

*2 JSR Corporation "JSR1502"

The invention claimed is:

1. A golf club head comprising a head main body made of a metal material, and a vibration absorber made of a visco-elastic material attached to the head main body, wherein the loss tangent of the vibration absorber exhibits its maximum value within a temperature range of −5 to 30 deg.C., the loss tangent at 30 deg.C. is not less than 0.50, the loss tangent at −40 deg.C. is not more than 0.10, and a difference of the loss tangent at 30 deg.C. from the loss tangent at −40 deg.C. is in a range of not less than 0.20 and not more than 0.70.

2. The golf club head according to claim 1, wherein the volume of the vibration absorber is in a range of 0.4 to 3.0 cc.

3. The golf club head according to claim 1, wherein the contact area between the vibration absorber and the head main body is in a range of 1.0 to 60.0 sq.cm.

4. The golf club head according to claim 1, wherein said visco-elastic material is 3,4-polyisoprene rubber.

5. The golf club head according to claim 1, wherein the vibration absorber is a sheet of the visco-elastic material having a substantially constant thickness, and fixed to the backside of a face portion by means of an adhesive agent.

6. A golf club head comprising a head main body made of a metal material, and a vibration absorber made of a visco-elastic material attached to the head main body, wherein the loss tangent of the vibration absorber exhibits its maximum value within a temperature range of −5 to 30 deg.C., the loss tangent at 30 deg.C. is not less than 0.50, the loss tangent at −40 deg.C. is not more than 0.10, a difference of the loss tangent at 30 deg.C. from the loss tangent at −40 deg.C. is in a range of not less than 0.20 and not more than 0.70, the vibration absorber is a sheet of 3,4-polyisoprene rubber having a substantially constant thickness and fixed to the backside of a face portion by means of an adhesive agent, the volume of the vibration absorber is in a range of 0.4 to 3.0 cc, and the contact area between the vibration absorber and the head main body is in a range of 1.0 to 60.0 sq.cm.

* * * * *